United States Patent [19]

Kuo

[11] Patent Number: 4,785,162

[45] Date of Patent: Nov. 15, 1988

[54] MULTIPLE-FUNCTION ELECTRIC DRYER HAVING AN ADJUSTABLE POSITION DISCHARGE NOZZLE

[76] Inventor: Dai-Ming Kuo, P.O. Box 10160, Taipei, Taiwan

[21] Appl. No.: 925,612

[22] Filed: Oct. 31, 1986

[51] Int. Cl.[4] ..... F24H 3/02; H05B 1/00; F26B 21/00

[52] U.S. Cl. ..... 219/368; 34/91; 34/96; 34/239; 34/243 R; 219/213; 219/364; 219/373; 219/380

[58] Field of Search ..... 34/243 R, 240, 96–101, 34/91, 92, 239; 219/360–364, 366–373, 379, 380, 213

[56] References Cited

U.S. PATENT DOCUMENTS

| | | | |
|---|---|---|---|
| 1,224,306 | 5/1917 | Lemp et al. | 219/364 X |
| 1,419,707 | 6/1922 | Watrous | 219/364 X |
| 1,419,712 | 6/1922 | Bassette | 219/364 X |
| 2,013,572 | 9/1935 | McCord | 34/96 X |
| 2,014,211 | 9/1935 | Schurig | 219/364 |
| 3,085,350 | 4/1963 | Waters | 34/91 |
| 3,939,574 | 2/1976 | Garot | 34/239 X |

FOREIGN PATENT DOCUMENTS

| | | | |
|---|---|---|---|
| 2215677 | 10/1972 | Fed. Rep. of Germany | 34/240 |
| 1102164 | 5/1955 | France | 34/243 R |

*Primary Examiner*—Anthony Bartis

[57] ABSTRACT

A multiple-function electric dryer includes a casing having a nozzle extending outwardly through opening formed in the front and bottom walls thereof and arranged for upward and downward angular movement about a horizontal axis within the confines of the nozzle opening, with the nozzle being in communication with a horizontal-pipe portion of a hot air supplier within the casing. The horizontal-pipe portion has an electric heating coil therein and is provided with an air fan on an air inlet hood communicating with a casing air inlet. A retractable horizontal grating mounted for vertical movement below the bottom wall provides for laying thereon of clothing or towels to be dried by air discharged from the nozzle when downwardly positioned. The grating has a central recess portion to accomodate downward angular movement of the nozzle and is adjustably positionable by a pair of vertical rods extending into the casing.

1 Claim, 4 Drawing Sheets

MULTIPLE-FUNCTION ELECTRIC DRYER HAVING AN ADJUSTABLE POSITION DISCHARGE NOZZLE

BACKGROUND OF THE INVENTION

Conventional hand dryer normally emitting air downwards for hand drying (A1) includes a nozzle N rotatably mounted on an inclined surface S of the dryer H around an axis S1 perpendicular to surface S, which may even be rotated counter clockwise (as shown in dotted line R of FIG. 1) to deliver air upwardly in a direction A2 for drying an user's wet hair. However, if the user tries to dry his or her hair but he or she is not tall enough to pose his or her head beyond the nozzle opening (direction A2), he or she must then rotate the nozzle to discharge air in direction A3 and tilt his or her body sidewards for hair drying to thereby cause tiredness and inconvenience of the user.

The present inventor has found this defect of a conventional hand dryer and invented the present multiple-function dryer.

SUMMARY OF THE INVENTION

The object of the present invention is to provide a dryer including a casing, an adjustable nozzle rotatably mounted on a hot air duct directing a heated air stream therethrough and a grating frame movably mounted on a rear wall of the casing and telescopically positioned under the casing so that the nozzle can be optionally adjusted to supply air adapted for drying an user hands or the user's hair regardless of his or her body height, and the grating frame can be pulled downwards and paved a towel or clothes placed thereon for drying the same, upon emitting hot air downwards from the nozzle when rotated downwards.

DETAILED DESCRIPTION

Figure 1:
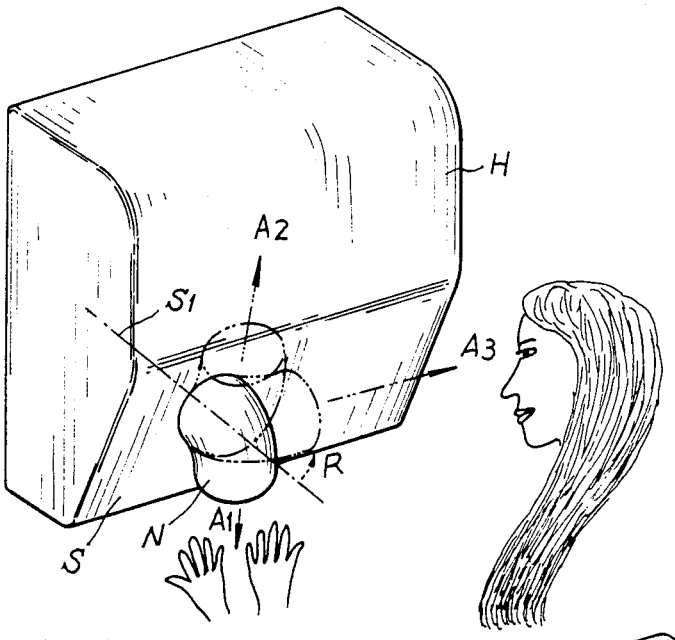
FIG.1 PRIOR ART
FIG. 1 is an illustration showing a conventional hand dryer.
Figure 2:
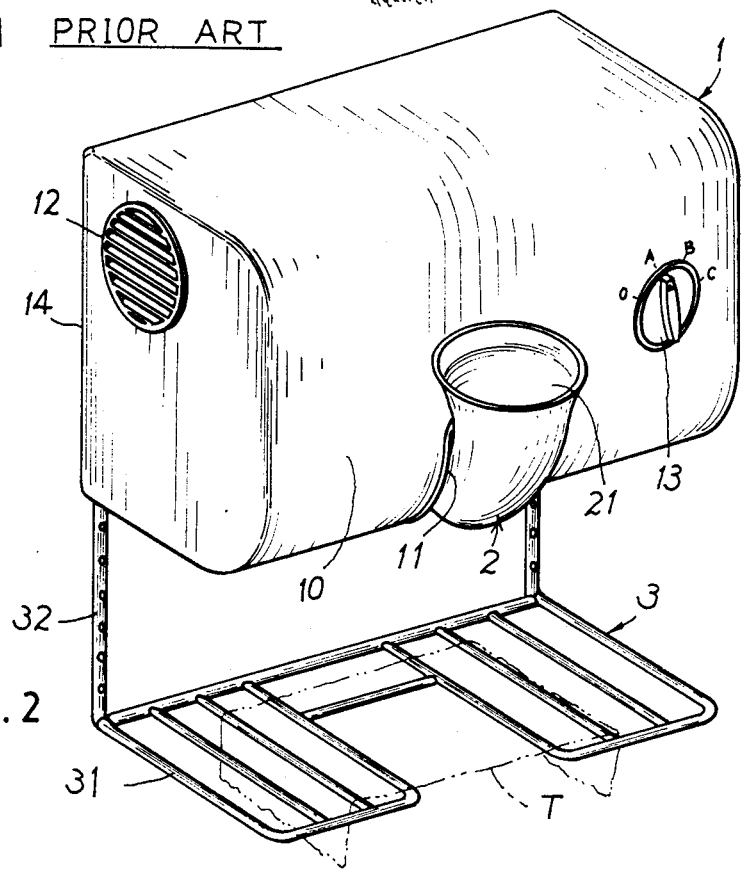
FIG. 2 is an illustration of the present invention.

As shown in FIGS. 2–7, the present invention comprises: a casing 1, a hot-air supplier 2 and a grating frame 3.

The casing 1 includes a front wall 10 having a selector knob 13 formed thereon, a nozzle opening 11 formed on the casing 1 to allow the angular movement of a nozzle 21 of the hot-air supplier 2, an air inlet hole 12 formed on a side wall of the casing, a rear wall 14 adapted for mounting the casing 1 on a wall such as in a toilet or lavatory room, and an arcuate plate 15 formed at the rear end of the opening 11 to limit the backward movement of the nozzle 21.

Figure 4:
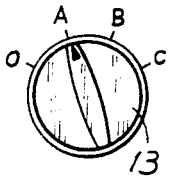
FIG. 4 shows a selector knob of the present invention.
Figure 6:
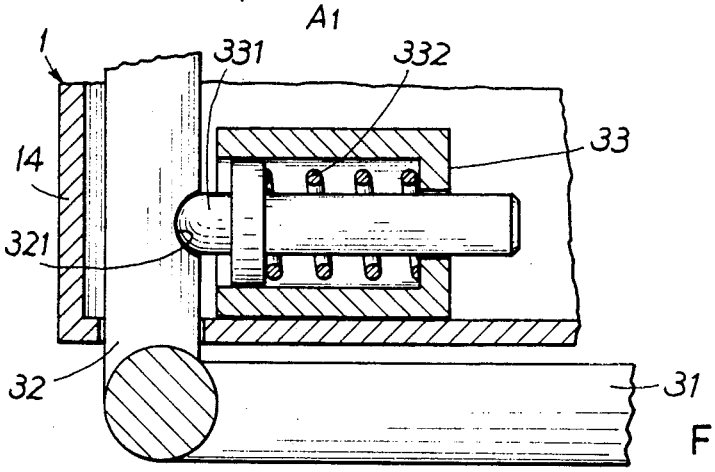
FIG. 6 is an illustration showing the positioning of a grating frame on a casing of the present invention.
Figure 5:
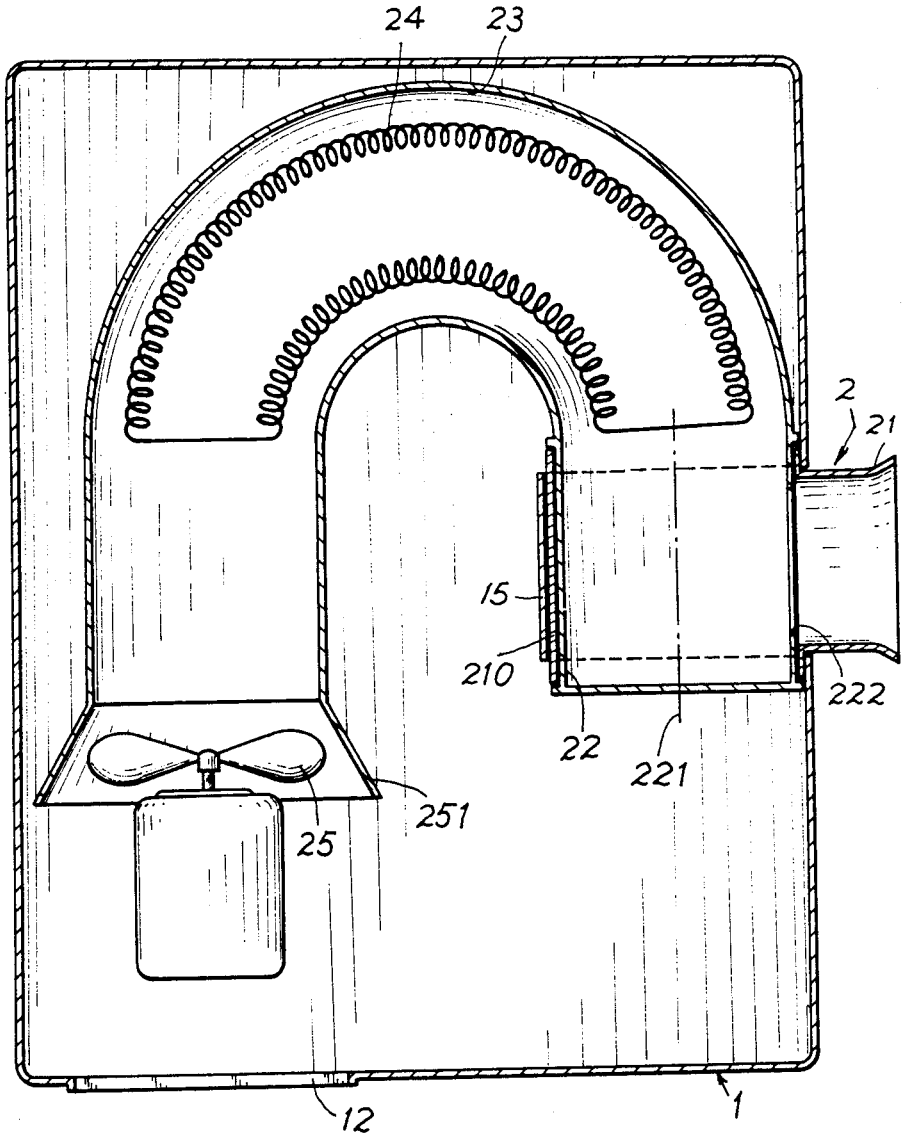
FIG. 5 is a top-view sectional illustration of the present invention.
Figure 7:
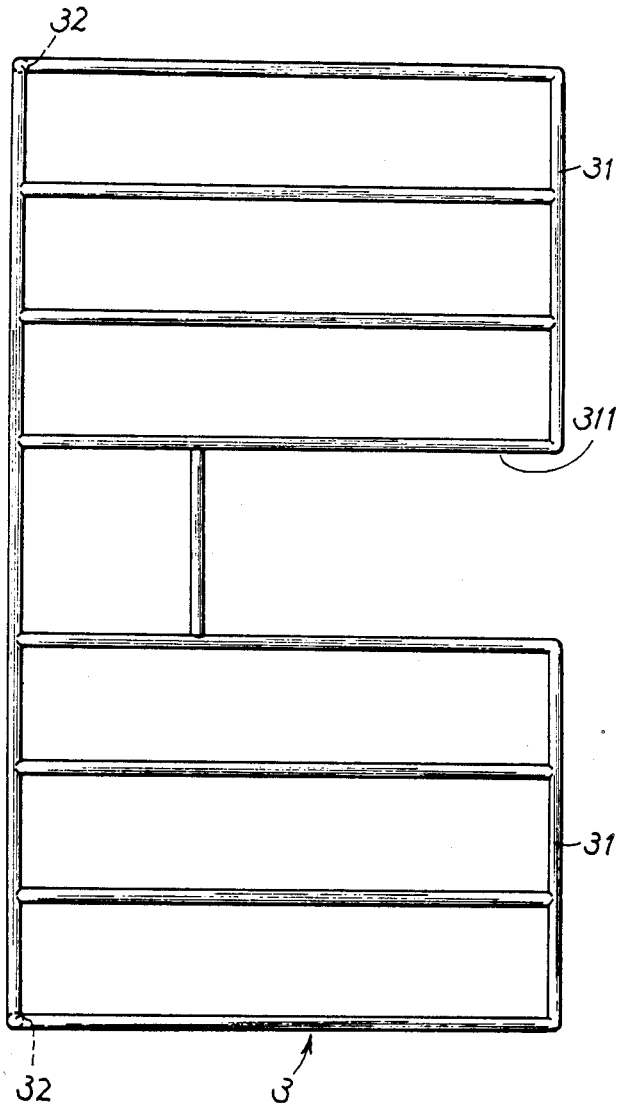
FIG. 7 is a top-view illustration of the grating frame of the present invention.

The selector knob 13 as shown in FIG. 4 may be designed to selectively point at O position to indicate the dryer being at "off" position, to point at A position to indicate the nozzle 21 aiming downwards (A1) with automatic starting and stopping the dryer such as sensed by an ultrasonic device, to point at position B to indicate the nozzle 21 adapted for optional drying at several angular positions with manual starting and stopping of the dryer, and to point at position C to indicate the nozzle 21 adapted for continuous or longer running of the dryer and drying of clothes or towel T put on the frame 3.

The hot-air supplier 2 includes a nozzle 21 protruding from a collar 210 rotatably mounted on a horizontal-pipe portion 22 around an axis 221 at the center of pipe 22 and fluidically communicated with an air outlet opening 222 formed on the end of the pipe portion 22 for blowing hot air outwards, a hot-air duct 23 connected to horizontal-pipe portion 22 has inserted therein an electric heating coil 24 and an air fan 25 is provided at the inlet hood 251 adjacent to the air inlet hole 12 of casing 1. The nozzle 21 is perpendicular to the axis 221 of the pipe portion 22.

The grating frame 2 includes a horizontal grating 31 having a central recess portion 311 allowing the angular movement of the nozzle 21 around the axis 221 and adapted for putting a towel or clothes T thereon, and a pair of vertical rods 32 each connected with the grating 31 and formed with a plurality of recesses 321. A pair of positioners 33 each having a latch 331 resiliently held by a spring 332 to engage with each recess 321 on the rod 32 are provided at the bottom rear of casing 1, whereby upon the pulling of the grating 31 downwards the grating can be adjustably positioned under the casing 1 for laying a towel or clothes thereon. Each vertical rod 32 is smoothly moved in guide collar 322 formed on the rear wall 14.

Figure 3:
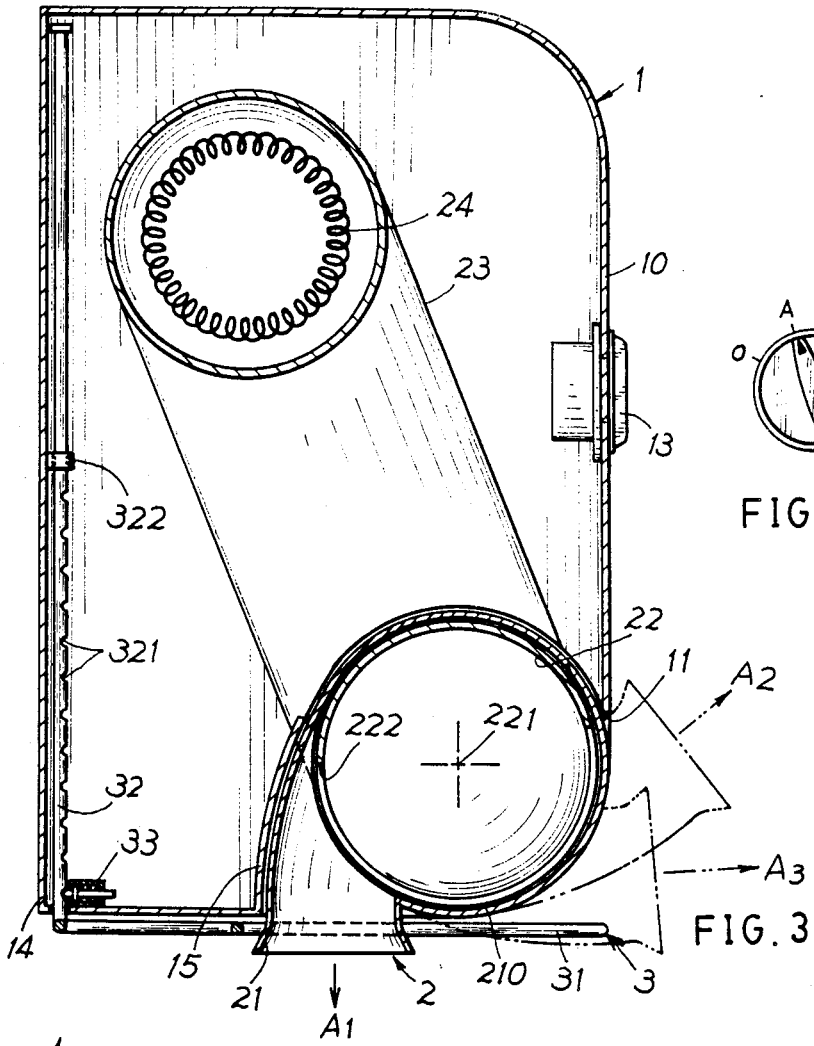
FIG. 3 is a side-view sectional drawing of the present invention.

When using the present invention for drying the user's hands, the nozzle 21 can be rotated as shown in FIG. 3 to allow the air to flow downwards in direction A1 for drying the hands as usual. If an adult wants to dry his hair, he may rotate the nozzle 21 around axis 221 to allow hot air upwards discharging in direction A2 as shown in dotted line. If a child having medium height desires to dry his hair, he may then rotate the nozzle 21 to allow air to discharge in direction A3 for drying the hair with comfortable angle or pose. Since the hot air is blown directly towards the user's head or his body regardless of height of the user by merely adjusting the angular movement of the nozzle 21 around the axis 221, the present invention can therefore provide a comfortable drying appliance with optional and convenient adjustment of the nozzle.

For drying a towel or clothes T, the grating 31 is pulled downwards and optionally positioned as locked by the positioners 33 for laying down a towel or clothes thereon, and the nozzle 21 is rotated to allow the hot air directly flowing onto the laid towel or clothes. If it is not used, the grating 31 can be retracted upwards proximate to a bottom wall of the casing 1.

I claim:

1. A dryer comprising:

a casing having a front wall and a bottom wall, a nozzle opening formed on the lower portion of the front wall and the front portion of the bottom wall adapted for the angular movement of a nozzle about a horizontal axis within the confines of the nozzle opening;

a hot-air supplier in said casing including a nozzle extending outwardly through said opening for blowing hot air outwards, said nozzle protruding from a collar rotatably mounted on a horizontal-pipe portion of said hot air supplier and being perpendicular to an axis aligned with the center line of said pipe portion such that said nozzle with said collar can be selectively rotated around said axis of said horizontal-pipe portion within the confines of said nozzle opening, said horizontal-pipe portion being connected with a hot-air duct having an electric heating coil therein and provided with an air fan on an air inlet hood communicating with a casing air inlet; and a grating frame telescopically mounted on said casing below the bottom wall thereof including a horizontal grating for laying towels or clothes thereon, said grating having a central recess portion located with respect to the nozzle opening in said casing bottom wall to allow the angular movement of said nozzle therethrough and a pair of vertical rods each connected with said horizontal grating and extending upwardly into said casing, a pair of positioners on said casing each having a latch resiliently held by a spring to engage with each of the plural recesses formed on each said vertical rod to adjustably position said grating under said casing for drying the towel or clothes laid thereon after rotation of said nozzle downwards for discharging hot air directly onto said towel or clothes, and whereby upon the rotation of said nozzle around said horizontal-pipe portion within the confines of said nozzle opening, the hot air as blown through said nozzle can be selectively adjusted for its blowing directions.

* * * * *